US007676965B1

(12) United States Patent
Nathenson et al.

(10) Patent No.: US 7,676,965 B1
(45) Date of Patent: Mar. 16, 2010

(54) AIR POWERED VACUUM APPARATUS

(75) Inventors: Richard D. Nathenson, Pittsburgh, PA (US); Steven J. Nathenson, Pittsburgh, PA (US)

(73) Assignee: Guardair Corporation, Chicopee, MA (US)

( * ) Notice: Subject to any disclaimer, the term of this patent is extended or adjusted under 35 U.S.C. 154(b) by 382 days.

(21) Appl. No.: 11/704,895

(22) Filed: Feb. 9, 2007

Related U.S. Application Data

(60) Provisional application No. 60/771,712, filed on Feb. 9, 2006.

(51) Int. Cl.
*E02F 3/94* (2006.01)

(52) U.S. Cl. ..... 37/317

(58) Field of Classification Search ..... 37/307, 37/317–323; 172/22, 23; 175/66, 67, 424, 175/324, 213; 406/88, 96, 113, 153, 157; 405/163; 414/318, 716, 733, 550.8, 306; 198/550.1, 494
See application file for complete search history.

(56) References Cited

U.S. PATENT DOCUMENTS

| | | | | |
|---|---|---|---|---|
| 1,509,090 | A | 9/1924 | Allyn | |
| 2,268,656 | A | 1/1942 | Haltmeier | |
| 2,310,265 | A | 2/1943 | Sweeny | |
| 2,631,774 | A | 3/1953 | Plummer, Jr. | |
| 3,877,238 | A * | 4/1975 | Chang et al. | 405/162 |
| 4,379,679 | A | 4/1983 | Guile | |
| 4,776,781 | A | 10/1988 | Sakai | |
| 4,898,517 | A | 2/1990 | Eriksen | |
| 4,936,031 | A | 6/1990 | Briggs et al. | |
| 5,087,175 | A | 2/1992 | Raizman et al. | |
| 5,140,759 | A | 8/1992 | Artzberger | |
| 5,361,855 | A | 11/1994 | Schuermann et al. | |
| 5,487,229 | A | 1/1996 | Nathenson et al. | |
| 5,782,414 | A | 7/1998 | Nathenson | |
| D408,830 | S | 4/1999 | Nathenson et al. | |
| 6,000,151 | A | 12/1999 | Hayes | |
| D435,207 | S | 12/2000 | Nathenson et al. | |
| 6,254,315 | B1 * | 7/2001 | Pfeiffer | 406/117 |
| 6,877,960 | B1 | 4/2005 | Presz, Jr. et al. | |

OTHER PUBLICATIONS

"Norclean Industrial Vacuum", pp. N1-N2, AB Ph. Nederman & Co.

* cited by examiner

*Primary Examiner*—Robert E Pezzuto
(74) *Attorney, Agent, or Firm*—The Webb Law Firm

(57) ABSTRACT

An air powered vacuum apparatus for use in an air vacuum excavation system creates a fluid flow under vacuum and reduces the sound level of the exhausting air. The apparatus comprises an injector assembly and a container for collecting spoil, i.e., dirt, sand, gravel, etc. drawn in from the excavation site. The vacuum is produced by an injector and a supersonic nozzle assembly in fluid communication with the container. The injector has converging, straight and diverging sections, and the supersonic nozzle assembly extends into the converging section. The supersonic air ejected from the nozzle assembly mixes with the air drawn up from the container, and the air mixture travels through the diverging section and out of the injector assembly and creates a vacuum in the container.

27 Claims, 5 Drawing Sheets

AIR POWERED VACUUM APPARATUS

CROSS REFERENCE TO RELATED APPLICATIONS

This application is based on Provisional Patent Application No. 60/771,712 filed Feb. 9, 2006, on which priority of this patent application is based, and which is hereby incorporated by reference in its entirety.

BACKGROUND OF THE INVENTION

1. Field of the Invention

The invention relates to a vacuum excavation system of the type which uses high velocity air to loosen the soil and a pneumatic vacuum to remove the loosened soil, and in particular, to an air vacuum excavation system having an improved air powered vacuum apparatus including an injector assembly for reducing the sound level of the supersonic air traveling through the air powered vacuum apparatus and creating a powerful vacuum in the spoil or material collection container for drawing the spoil or material into the container.

2. Description of Related Art

Vacuum excavation systems are well known. U.S. Pat. Nos. 4,776,781; 4,936,031; 5,140,759; 5,361,855; and 6,000,151 disclose pneumatic soil excavation systems in which a jet of air is directed against a mass of soil by a hand-held nozzle to cause the mass to break up, and in which the loosened soil is collected by entraining it in an air flow carried by a pipe or conduit, and depositing the entrained soil at a site away from the excavation.

Air vacuum excavation systems can safely uncover any type of buried object. These prior art systems that are provided by the assignee of this patent application use a synergistic combination of supersonic jets of air and high flow pneumatic vacuum transport. Supersonic air jets are extremely effective for penetrating most types of soil, and are harmless to all types of non-porous buried objects. That is, these supersonic air jets can be used to uncover, without fear of damage or disruption to gas, water or sewer pipes; electric or fiber optic cables; hazardous waste tanks, drums, boxes, cartons or bottles; or unexploded ordnance such as bombs or mines. Soil traditionally is not material that can easily be vacuumed, and therefore, it needs to be handled efficiently and effectively.

Safe soil excavation becomes more important daily, especially to industry and government. Commercial contractors, using conventional excavation equipment for locating buried utility equipment, such as wires, cables, etc., can have hundreds of accidents each year involving major property damage and loss of life. Accidental severing of a transcontinental fiber optic line may cost the industry over $1.5 million per hour in lost revenue. Additionally, federal and local governments may have a priority for environmental remediation to return land to the public in a clean and useable condition. Landfills can have over 4 million cubic yards of buried waste contaminated with hazardous and radioactive substances. Military operations conducted at test or impact ranges and training or detonation areas can have millions of acres of government owned property buried with unexploded ordnance. It has been demonstrated that the use of conventional excavation equipment may be too dangerous, resulting for example, in deterioration of buried drums or detonation of buried unexploded bombs and shells.

Above-discussed U.S. Pat. No. 6,000,151 discloses a vacuum excavation apparatus having an air lance for directing air at supersonic speeds at a material to be excavated and a material pickup hose for removing the loosened dirt from the excavation. The pickup hose is connected to a vacuum engine which is attached to an airtight material collection drum and which is operated by a foot operated air valve. The air supply for the vacuum engine and the air supply for the air lance are supplied by compressed air hoses from a single portable air compressor, which may be located in near proximity or may be remotely located, i.e., over 200 feet away from the vacuum engine and the air lance.

Air powered venturi vacuums are well known. Several varieties of drum top vacuums may be purchased commercially. These generally consist of a lid attached to a material collection drum, a suction generating device mounted on the lid, a compressed inlet air connected to the suction device, an air suction inlet means and an air discharge means. A 55 gallon drum full of soil can weigh over 700 pounds and can be very difficult to empty. There may or may not be an inlet or outlet filter and/or a discharge silencer associated with the vacuum engine and/or material collection drum.

U.S. Pat. No. 6,000,151 also discloses a vacuum engine as having a multistage venturi ejector with an exit discharge bag. The device of the '151 patent is sold commercially under the UTILIVAC® trademark. This ejector uses a complicated system of internal valves to direct the suction air through a particular chamber section in order to change the head/flow relationship. Another example of a multistage venture ejector system is commercially available under the Norclean trade name. This system also employs a complicated arrangement with multiple jet pumps in parallel where compressed air passes through specially designed nozzles and venturi pipes at supersonic velocity.

It is known that the excavation and vacuum transport of soil has its own unique set of characteristics. For example, soil types vary widely in grain size, particle shape, packing, moisture content, grading, plasticity, organic matter content, etc. Therefore, soils may not generally be free flowing materials that are easily removed or moved by conventional pneumatic transport. In some instances, special care may have to be taken in designing the vacuum transport system in order to avoid the persistent problem of cohesive materials clogging within the vacuum excavation system, such as that disclosed in U.S. Pat. No. 5,487,229.

In the literature for the design of industrial vacuum systems, conveying velocities and average soil densities for various materials are published and well known. For example, the average soil density for dry clay may be about 60 pounds per cubic foot and the average soil density for dry, packed sand and gravel may be as high as 120 pounds per cubic foot, and the recommended conveying velocities may range from 3,500 to 5,800 feet per minute for these types of materials. As a reference, 300 cubic feet per minute (cfm) of soil traveling through a 3-inch diameter hose translates to an air velocity of 6,100 feet per minute. In practice, however, if the soil is wet, higher conveying velocities ranging from 9,000 to 11,000 feet per minute may be needed.

There is a need, therefore, to provide a simpler and improved construction for an air powered vacuum apparatus in an air vacuum excavation system which uses an air nozzle to loosen the dirt or spoil and an air compressor for supplying air to the air nozzle and to the air powered vacuum.

There is also a need to provide an improved air powered vacuum apparatus in an air vacuum excavation system which is safe, efficient and easily operated.

There is still a further need to provide an air powered vacuum apparatus in an air powered excavation system that can pneumatically excavate and then transport any type of material, e.g. dirt, soil, sand, gravel, etc. regardless of its characteristics.

SUMMARY OF THE INVENTION

The invention has met the above needs. The invention provides an air powered vacuum apparatus having a spoil collecting container and an injector assembly in fluid communication with the container which creates a vacuum for drawing the spoil or material into the container. The injector assembly has a supersonic air nozzle associated with an injector that has a converging section, a straight section and a diverging section. The injector is in association with a tube which has a length that extends beyond an end of the diverging section of the injector assembly thereby creating a fluid flow under vacuum and reducing the sound level of the fluid being exhausted or ejected out of the diverging section of the injector assembly.

More specifically, the invention provides an air powered vacuum apparatus in an air vacuum excavation system comprising a container for drawing in and collecting spoil and an injector assembly connected to and in communication with the container and with a supply of compressed fluid and configured to convert the compressed fluid into supersonic fluid and then into subsonic fluid to create a vacuum for drawing the spoil into the container. The injector assembly comprises a conduit having a fluid inlet in communication with the container and adapted to be coupled to the compressed fluid supply a supersonic nozzle assembly connected to the compressed fluid supply for using the compressed fluid and ejecting supersonic fluid, an injector associated with the supersonic nozzle assembly and the conduit, comprising at least a converging section, a straight section, and a diverging section. The supersonic nozzle assembly is positioned inside the converging section of the injector. The straight section of the injector acts as a mixing chamber for mixing the supersonic fluid from the nozzle assembly with the fluid traveling from the container. The conduit includes a tee pipe and a tube and the tube has a straight length that extends beyond the diverging section of the injector for the reducing of the sound level of fluid being ejected from the diverging section of the injector of the injector assembly.

The present invention further provides an injector assembly for creating an air flow under vacuum and for reducing the sound level of the exhausting air comprising a conduit adapted to be coupled to a compressed air supply, a supersonic nozzle connected to the conduit for using the compressed air and converting it into supersonic air and for ejecting the supersonic air, an injector associated with an air source and being in fluid communication with the supersonic nozzle assembly, comprising a converging section, a straight section and a diverging section, and wherein the conduit includes a tube associated with the diverging section of the injector. The supersonic nozzle assembly is positioned inside the converging section of the injector assembly. The supersonic air ejected from the supersonic nozzle assembly travels into the straight section of the injector and mixes with the air from the air source. The tube has a length that extends beyond the diverging section of the injector for the reducing of the sound level of air traveling out of the diverging section of the injector of the injector assembly The supersonic air traveling through the injector creates the air flow under vacuum in the air source.

The injector assembly and the container are connected together and are positioned either in a vertical position or in a horizontal position, the latter position being especially accommodating for mounting the injector assembly and the container on a truck or trailer.

The tube may house the injector of the injector assembly or it may be connected to the end of the diverging section of the injector.

It is a further object of the invention to provide an improved air powered vacuum apparatus which can be efficiently and safely used in air vacuum excavation systems for excavating buried objects, such as pipes, cables, landmines, unexploded ordnance and tree roots. An advantage of this air vacuum excavation system is that it is also non-damaging to the buried objects.

A further object of the invention is to provide an improved air powered vacuum apparatus which provides a powerful vacuum for suctioning the spoil into the container and which reduces the sound level of the air being exhausted from the apparatus to acceptable levels.

These and other objects of the invention will be better appreciated and understood when the following description is read along with the accompanying drawings and the claims.

DETAILED DESCRIPTION OF THE INVENTION

The air powered vacuum apparatus of the invention may be used in combination with a supersonic air digging tool for superior performance of the vacuum excavation system. This supersonic air digging tool may be similar to that disclosed in U.S. Pat. No. 5,782,414, U.S. Design No. D408,830, and U.S. Design No. D435,207, all of which are herein incorporated by reference in their entirety.

It is to be understood that the term "spoil" can be used interchangeably with the term "material" and as used herein encompasses any type of material that is excavated, which may include dirt, soil, debris, sand, gravel, rocks, water and contaminants.

Figure 1:
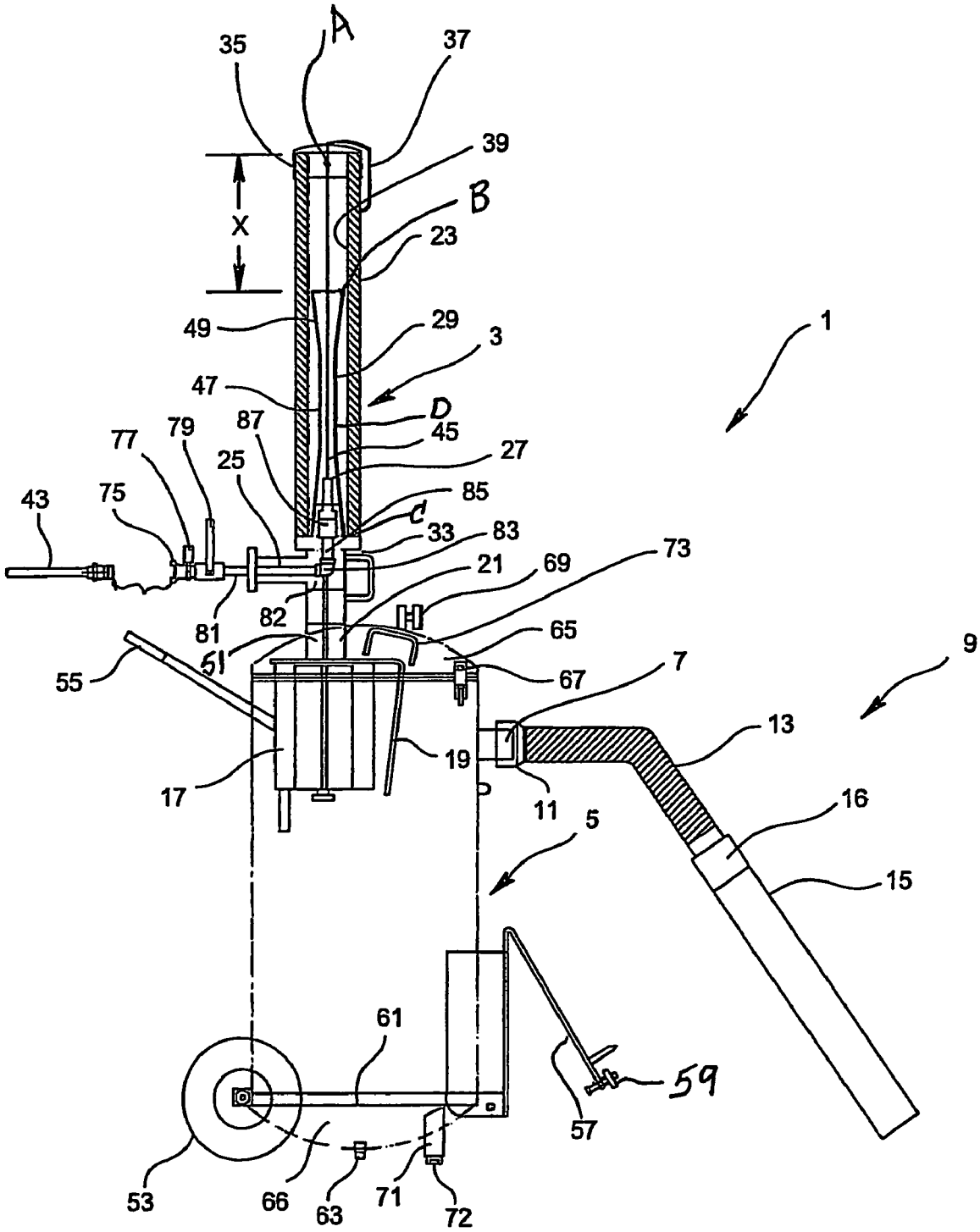
FIG. 1 is an elevational view, partially in section, of an air powered vacuum apparatus representing a first embodiment of the invention in a vertical positioning made in accordance with the present invention.

FIG. 1 illustrates a first embodiment of the invention for the air powered vacuum apparatus 1 and includes an injector assembly 3 and container 5 (shown in phantom) for collecting and carrying excavated material or spoil. Container 5 may be a tank or drum and has a vacuum inlet 7 in fluid communication with container 5. A removable suction tube assembly 9 to the right of container 5 in FIG. 1 is coupled to vacuum inlet 7 and is in fluid communication with the interior of container 5. Suction tube assembly 9 includes a coupling 11 for connection to vacuum inlet 7, a flexible suction hose 13, a rigid suction tube 15 and a coupling 16 for connecting suction hose 13 to suction tube 15.

The removable suction tube assembly 9 may be any material pick-up hose assembly available in the art for removing loosened spoil from the excavation site. Suction hose 13 may be a commercially available flexible hose and suction tube 15 may be a PVC (polyvinyl chloride) pipe or conduit. It is to be noted that vacuum inlet 7 can be sized to match the minimum or the maximum hose diameter so that a variety of hoses can be used with the same container 5.

The air powered vacuum apparatus 1 of the invention generally will be used in conjunction with a suitable excavation tool such as that disclosed in U.S. Pat. No. 5,782,414. Spoil to be vacuumed is first loosened and broken into small pieces by the excavation tool, and then the open end of the suction tube 15 of removable suction tube assembly 9 is brought close to the spoil such that the air stream flowing through the system entrains the spoil. It is not desirable to deadhead the system by completely blocking off the end of suction tube 15. Although the suctioning force may rise sharply, the airflow in the system will tend to drop to zero, thereby allowing the excavated spoil to drop out onto the interior of the hose 13 and suction tube 15. Particles which are relatively minute compared to the diameters of hose 13 and suction tube 15 are generally easily entrained and carried through the hose and suction tube. Whereas larger particles that are greater or about one half the size of the diameter of the hose 13 and suction tube 15 are more difficult to be carried through the hose and suction tube resulting in these larger particles wedging or jamming together in the system.

Still referring to FIG. 1, container 5 preferably is cylindrical in shape and further includes a filter assembly 17 and an impact plate 19, both located in close proximity to vacuum inlet 7. The filter assembly permits gas to pass through but not said particles above a certain size, and are well known in the art. Such a filter can be made of cloth or a fibrous material. An exit port 21 is provided at the upper portion of container 5 and is in fluid communication with filter assembly 17. Injector assembly 3 is mounted directly onto exit port 21 of container 5.

Figure 2:
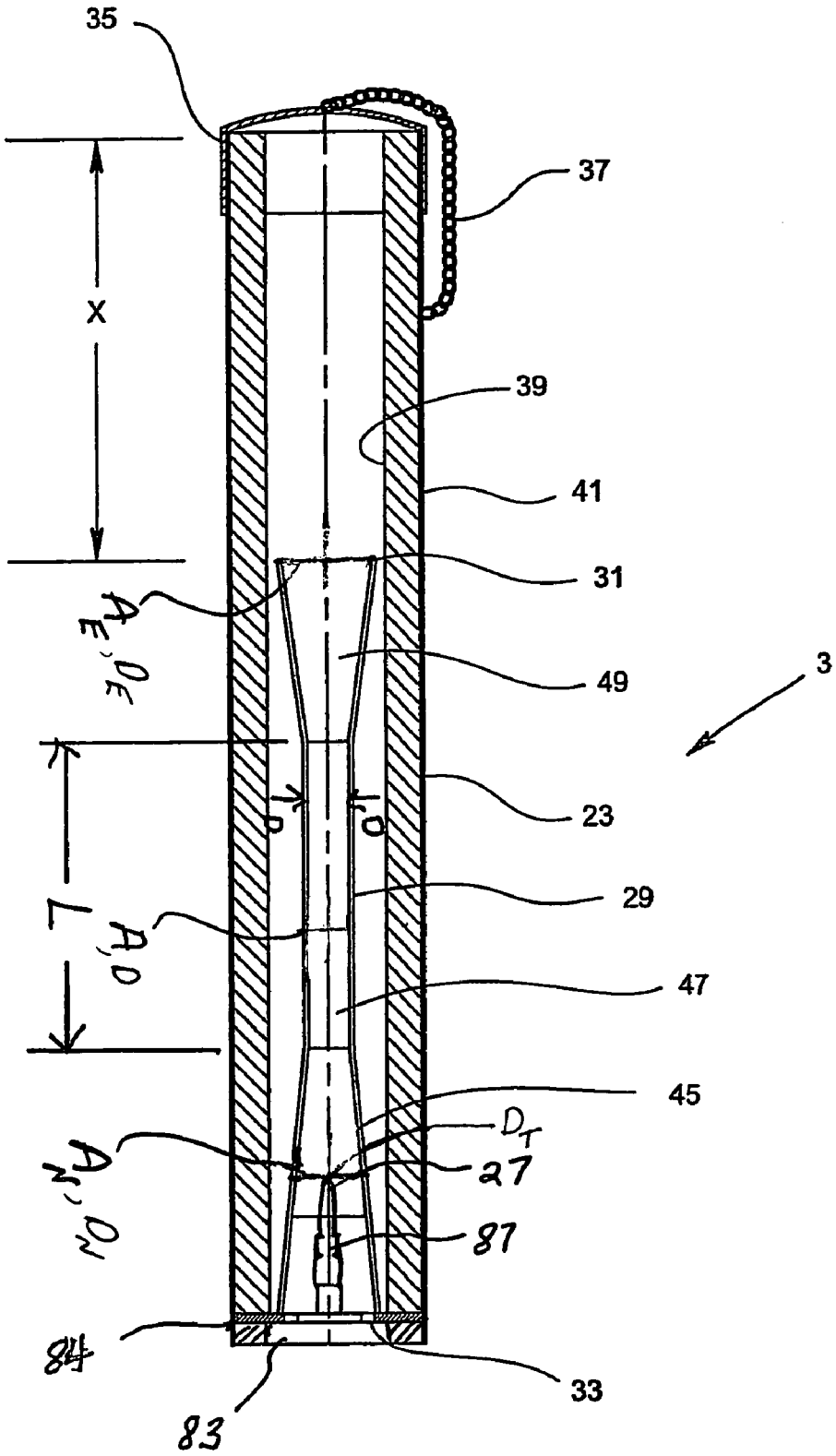
FIG. 2 is an enlarged elevational view of an injector and tube of the injector assembly, partially in section, shown in FIG. 1.

Referring to FIGS. 1 and 2, injector assembly 3 includes a conduit comprised of a tube 23 (shown in cross-section), a supersonic nozzle assembly 27 and an injector 29. Tube 23 has a fluid inlet 33 (shown best in FIG. 2) which is in direct fluid communication with the interior of container 5 via exit port 21 of container 5 (FIG. 1). As shown in FIG. 2, tube 23 extends beyond an upper end 31 of the injector 29, and has a removable cap 35 which is attached to tube 23 via a chain 37. By extending the length of tube 23 a length "X" beyond the injector 29, a simple and silent air vacuum arrangement is created. This length "X" can range from about 1 to about 2 feet from the top of injector assembly 29. The inner surface of tube 23 has a cylindrical layer as indicated at 39, which preferably is made of acoustic material or foam, and has an outer cylindrical layer, indicated at 41, which may be made of PVC or other plastics.

Figure 3:
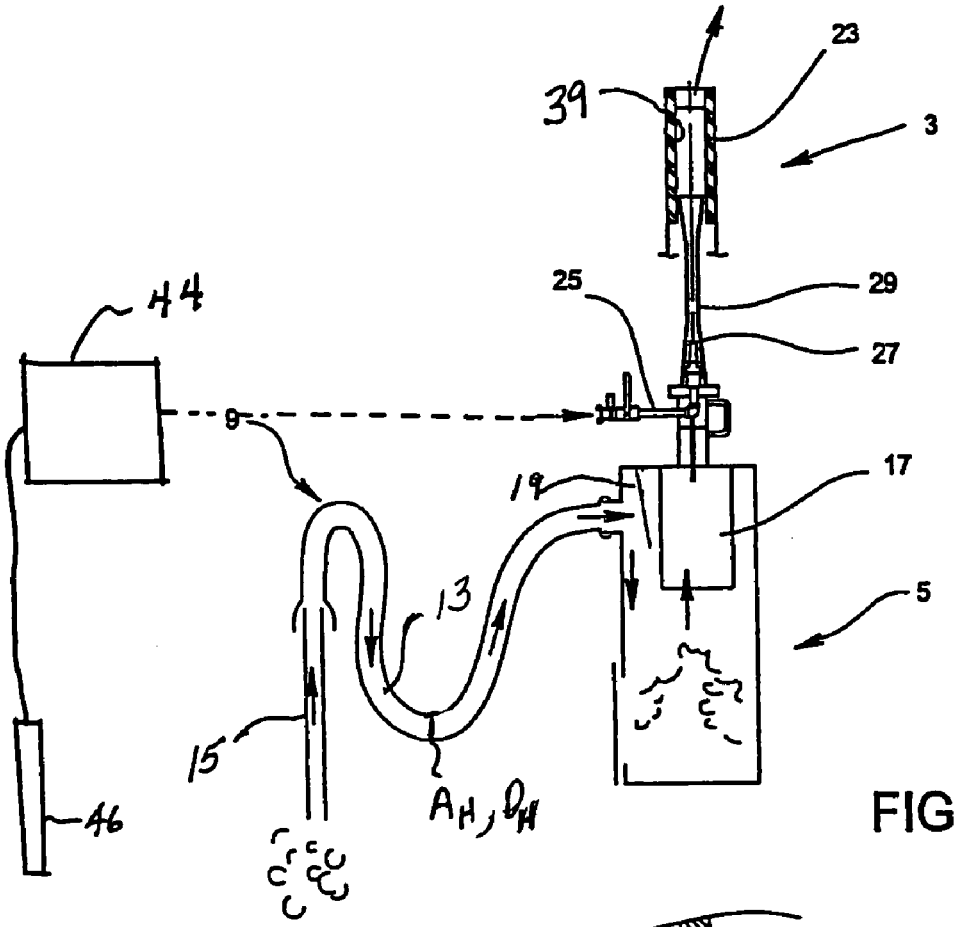
FIG. 3 is a schematic elevational view showing the vacuum air flow in the container and exiting the tube of the injector assembly of the embodiment of FIG. 1.

Referring to FIGS. 1 and 3, supersonic nozzle assembly 27 is coupled via a pipe 25 and hose 43 to a compressed air supply provided by air compressor 44 and which air compressor 44 also supplies compressed air to an air jet digging tool 46 which acts to loosen soil in a manner well known in the art. The supersonic nozzle assembly 27 is located near the fluid inlet 33 of tube 23, and injector 29 is in fluid communication with the fluid inlet 33 and with supersonic nozzle assembly 27. Nozzle assembly 27 extends up into the injector 29 in tube 23 near the fluid inlet 33 of tube 23. Supersonic nozzle assembly 27 receives the compressed air and converts it into supersonic air and ejects this supersonic air into injector 29.

Nozzle assembly 27 may be similar to the converging/diverging supersonic nozzle assembly disclosed in U.S. Pat. No. 5,782,414, the teachings of which are herein incorporated by reference in its entirety. The compressed air for supersonic nozzle assembly 27 is provided directly to the supersonic nozzle assembly 27 via standard hose connections, one shown at hose 43 and portable air compressor 44. Compressor 44 may be in close proximity to the air powered vacuum apparatus 1 or which compressor may be remotely located relative to the air powered vacuum apparatus 1.

As shown clearly in FIGS. 1 and 2, the injector 29 of injector assembly 3 is positioned in tube 23 and has a converging section 45, a straight section 47 and a diverging section 49, and as best shown in FIG. 1, the supersonic nozzle assembly 27 is positioned inside the converging section 45 in fluid communication with injector 29. It is to be appreciated that even though not shown, injector 29 is co-axial, i.e., symmetric about the longitudinal A and fits snugly into tube 23. The length of converging section 45 may range from about 6 inches to about 10 inches. The length of straight section 47 may range from about 10 inches to about 18 inches. The diameter of straight section 47 is about 1.5 to about 2.5 inches. The length of diverging section 49 may range from about 6 inches to about 10 inches. Injector 29 may be made preferably of stainless steel to avoid rusting. Preferably, the ends B and C of the injector frictionally engage with the inner surface D of the tube 23 so that the injector 29 snugly fits or is attached to the tube 23.

The lengths and diameters of sections 45, 47, and 49 are chosen along with the compressed air according to the size of the inlet hose 13. This relationship is shown in Table 1 below. The largest diameter for the converging section 47 and the diverging section 49 may range from 3 inches to 4 inches. For optimal performance of the injection assembly 3 reference is made to FIG. 2 and to Table 1 below. The ratio of L/D where L is the length of section 47 and D is the diameter of section 47 would be about 7 to 8. The ratio of the annular area, i.e. $A_N/A$ where $A_N$ is the annulus area of section 45 near the tip of nozzle assembly 27 and A is the area of mixing section 47 would be about 2. The ratio of the square root of $A_E/A$ where $A_E$ is the area near the exit end of section 49 and A is the area of mixing section 47, would be about 1.5 to about 2.5. The area $A_H$ (FIG. 3) of hose 13 would be about equal to the area of $A_E$. Referring to FIG. 2

$$A_E = \frac{\pi D_E^2}{4},$$

where $D_E$ is the exit diameter where $A_E$ is measured;

$$A = \frac{\pi D^2}{4},$$

where D is the diameter, where A is measured and $$A_N = \frac{\pi(D_N^2 - D_T^2)}{4},$$

where $D_N$ is the diameter where $A_N$ is measured and $D_T$ is the diameter of the nozzle tip where $A_N$ is measured. Referring to FIG. 3, $$A_H = \frac{\pi D_H^2}{4},$$

where $D_H$ is the diameter of the hose where $A_H$ is measured.

As particularly shown in FIG. 1, the components of injector assembly 3 are connected together as a unit, which can then be removed from container 5 via a handle 51 and carried separately.

Container 5 will now be discussed in detail with reference to FIG. 1. Container 5 has two wheels (one of which is shown at 53) and handles 55 (one of which is shown) for easy manual transportation. A wide dump door 57 with latches 59 (one of which is shown) is located at the bottom of container 5 opposite the wheels for easy removal of the spoil. Preferably the wheel base is less than 32 inches so that the entire apparatus 1 can easily fit through standard size gates and doorways. Container 5 has a false bottom plate 61 made of a plastic material to facilitate spoil removal. A drain plug 63 is located at the bottom of container 5 for water removal. Container 5 may be constructed of material sufficiently strong to withstand the vacuum created in container 5. Such material may be steel or aluminum. A removable lid 65 located at the top of container 5 is held in place by latches, one of which is shown at 67, and provides access into the interior of container 5. The removable lid 65 and the bottom of container 5 have a dish configuration which aids the container 5 to withstand the vacuum created in the container. A vacuum gauge 69 is mounted to lid 65 for indicating the working level of the vacuum created in container 5, and a foot 71 having a rubber surface 72 is attached to the bottom of container 5 opposite the wheels to support container 5 and prevent container 5 from rolling. Handles 73 (one of which is shown) mounted on removable lid 65 are provided for lifting the lid off of container 5.

It is to be understood that exit port 21 is located in removable lid 65. Injector assembly 29 fits snugly onto exit port 21, and as discussed hereinabove, is removable from container 5 for easy transporting and storage.

Referring again to FIG. 1, conduit 25 has a threaded coupling 75; an air pressure gauge 77 for the incoming compressed air; a ball valve 79; a threaded conduit or pipe 81 with a nipple; and a threaded elbow pipe 83 located in a tee pipe 82. As best shown in FIG. 2, the tube 23 is connected to the top of tee pipe 82. This is done through a flange (shown at 84) and bolts (not shown) in a well-known manner. This connection is such that the converging section 45 is in fluid communication with the tee pipe 82, inlet 21, and container 5.

Again referring to FIG. 1, the supersonic nozzle assembly 27 includes a threaded conduit 85 with a nipple; a nozzle connector 87 which fits onto threaded conduit 85; and supersonic nozzle assembly 27 which fits onto nozzle connector 87. Even though not shown, the components of conduit 25 and nozzle assembly 27 contain appropriate flanges and gaskets fastened together through suitable means, such as through nut and bolt assemblies. Conduit 25 and nozzle assembly 27 may be made of a material which is resistant to corrosion, for example, stainless steel.

Figure 4:
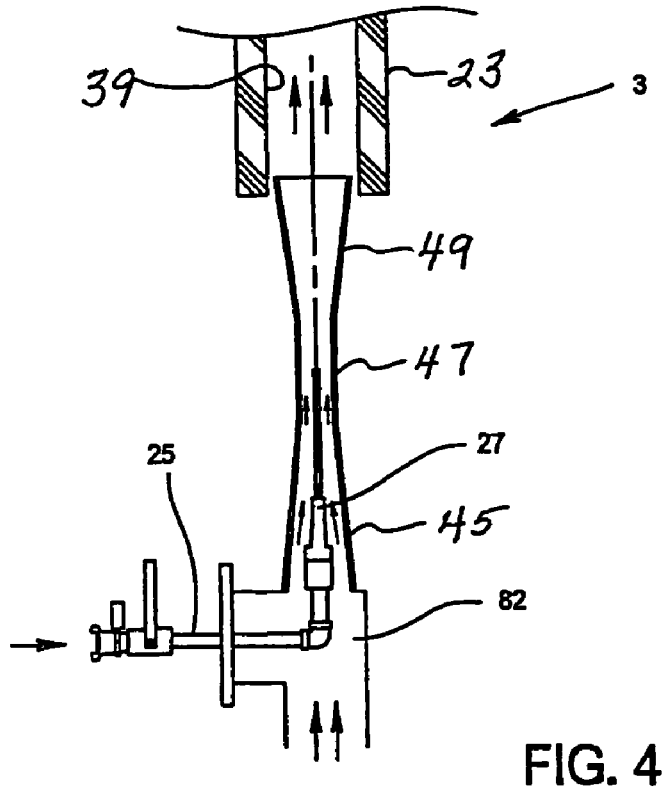
FIG. 4 is a schematic elevational view showing the air flow of the air traveling from the container and mixing with the supersonic air flow from the supersonic nozzle assembly of the embodiment of FIG. 1.

The operation of the air powered vacuum apparatus of the invention will now be given with reference to FIGS. 1, 3 and 4. Compressed air is provided into conduit 25 and exits at supersonic speed from nozzle assembly 27. Air passes through the injector 29 and exits at the top of tube 23 when cap 35 is removed. The exiting air from nozzle assembly 27 in cooperation with injector 29 causes a vacuum or suctioning force in the interior of container 5 thereby causing a vacuum to be drawn through the suction tube 15, which in turn, acts as a vacuum system for drawing spoil into container 5 (FIG. 3). As shown by the arrows in FIGS. 3 and 4, spoil drawn into container 5 via suction tube 15 hits the impact plate 19 and falls into container 5. Air brought into the container 5 passes through filter assembly 17. As shown in FIG. 4, the air from container 5 flows into the converging section 45. This air then mixes with the supersonic air ejected from supersonic nozzle assembly in the straight section 47 of injector 29 to become a subsonic air flow. This subsonic air flow travels through and out of the diverging section 49 of injector 29 to exhaust out of the end of tube 23 as a clean air stream. As shown in FIG. 3, as the subsonic air flow exits the top of diverging section 49, it travels along the inside of tube 23 and this effect along with the length "X" of the tube extending beyond the top of injector 29 (FIG. 1) reduces the sound level of the air flow exiting from tube 23.

As discussed hereinabove and referring to the figures, air and spoil entering container 5 through vacuum inlet tube 7 are forced toward the impact plate 19, which may be covered with a slippery, wear resistant, replaceable material such as UHMW (ultra high molecular weight) plastic. The contact of the spoil against the impact plate 19 causes the plate to absorb the kinetic energy of the spoil, thereby reducing the spoil's velocity to near zero such that the spoil falls downward in container 5, along with the air. The impact plate 19 is angled slightly from the vertical respect to FIGS. 1 and 3, thereby increasing the tendency of the spoil to fall downward instead of sticking to impact plate 19.

The spoil accumulates on the bottom of container 5 and gradually fills upward. The container 5 is completely full when the spoil reaches the bottom of impact plate 19 and blocks the airflow in the system. However, the air hitting against plate 19 and traveling downward in container 5 will turn upwardly behind impact plate 19 and into filter assembly 17. Since the container's cross-sectional area is much greater than the cross-sectional area of suction hose 13, most of the spoil is not re-entrained into the air. The filter assembly 17, however, serves to remove any fine dust-like particles that are light enough to be carried by the air.

Preferably, filter assembly 17 is a washable, polyester cartridge type filter that can remove from about 99.5% fine particles ranging between 0.2 to 2.0 microns. The filter assembly 17 is held in place via suitable means (not shown in FIG. 1), such as a nut and bolt assembly for easy replacement and removal. As discussed hereinabove, the air in container 5 exits container 5 and travels into tube 23 where it mixes with the high speed air exiting supersonic nozzle assembly 27, and this mixture then exits the system through the top of tube 23.

A vacuum is created in container 5 by the action of the high speed jet of air from supersonic nozzle assembly 27. The high speed jet of air draws the air from container 5 via exit port 21, mixes with the air drawn from container 5 in straight section 47 and this air mixture passes through diverging section 49 and exits out of the top of tube 23 at an acceptable decibel sound level that ranges somewhere in the low 80s dBA as measured at a distance of about 22 feet (7 meters) from the container 5.

In contrast to the injector assemblies used by current manufacturers, the injector assembly 3 of the invention is preferably straight and therefore has a low exit air pressure loss. Also, in view of the design of the injector assembly 3 of the invention, the air stream and its sound level are directed upward away from workers and the public, as shown in FIG. 1.

The dimensions, i.e., diameter and mixing length of converging section 45, straight section 47 and diverging section 49 of injector 29 are chosen to optimize the performance of the air powered vacuum apparatus of the invention. As discussed herein above, Table 1 illustrates the diameter of hose 13 the air velocity requirements needed when using compressed air at 90 psig, the diameter of the mixing tube 47, and the length of the mixing tube 47 in order to create a vacuum in container 5.

TABLE 1

| Compressed Air @ 90 psig for Creating Vacuum | | | |
|---|---|---|---|
| Hose 13 Diameter (inch) | 2.5 | 3.0 | 4.0 |
| Air Required (scfm) | 150 | 225 | 330 |
| Mixing Tube 47 - Diameter (inch) | 1.5 | 2.0 | 2.5 |
| Mixing Tube 47 - Length (inch) | 10 | 14 | 18 |

The operation of injector 29 may be described by the following equation (1):

$$\Delta P_i = \frac{\rho Q(V2 - 2V_{avg})}{A} \quad (1)$$

Where:

$\Delta P_i$=Pressure rise

ρ=Standard air density

Q=Air flow

A=Cross-sectional area of the mixing tube

V2=Supersonic velocity of jet from nozzle assembly 27

$V_{avg}$=Average of Injector Inlet and Exit Velocities

Several parameters of equation (1) are relevant to the performance of injector 29 and nozzle assembly 27. Superior performance is attained by having nozzle assembly 27 designed similar to that disclosed in U.S. Pat. No. 5,782,414. Small mixing tubes generate high suction but also have high frictional losses which subtract from the available pressure in the overall system. The pressure rise is also directly proportional to the amount of compressed air used for the air flow, Q. It is known that if a vacuum system has a mixing tube diameter that is constrained to be the same as the diameter of the inlet hose that delivers the compressed air, then large amounts of compressed air are needed in order for the system to function sufficiently.

It has been found by the inventors that the supersonic nozzle assembly 27 of the invention if designed similar to that patented in U.S. Pat. No. 5,782,414 provides superior performance when used in conjunction with the injector 29 of the injector assembly 3 of the invention. This is demonstrated by the experimental data shown in FIG. 6 for the injector assembly 3 of the invention compared to injector assemblies of two commercially available systems. All three injector assemblies used similar amounts of compressed air.

Figure 6:
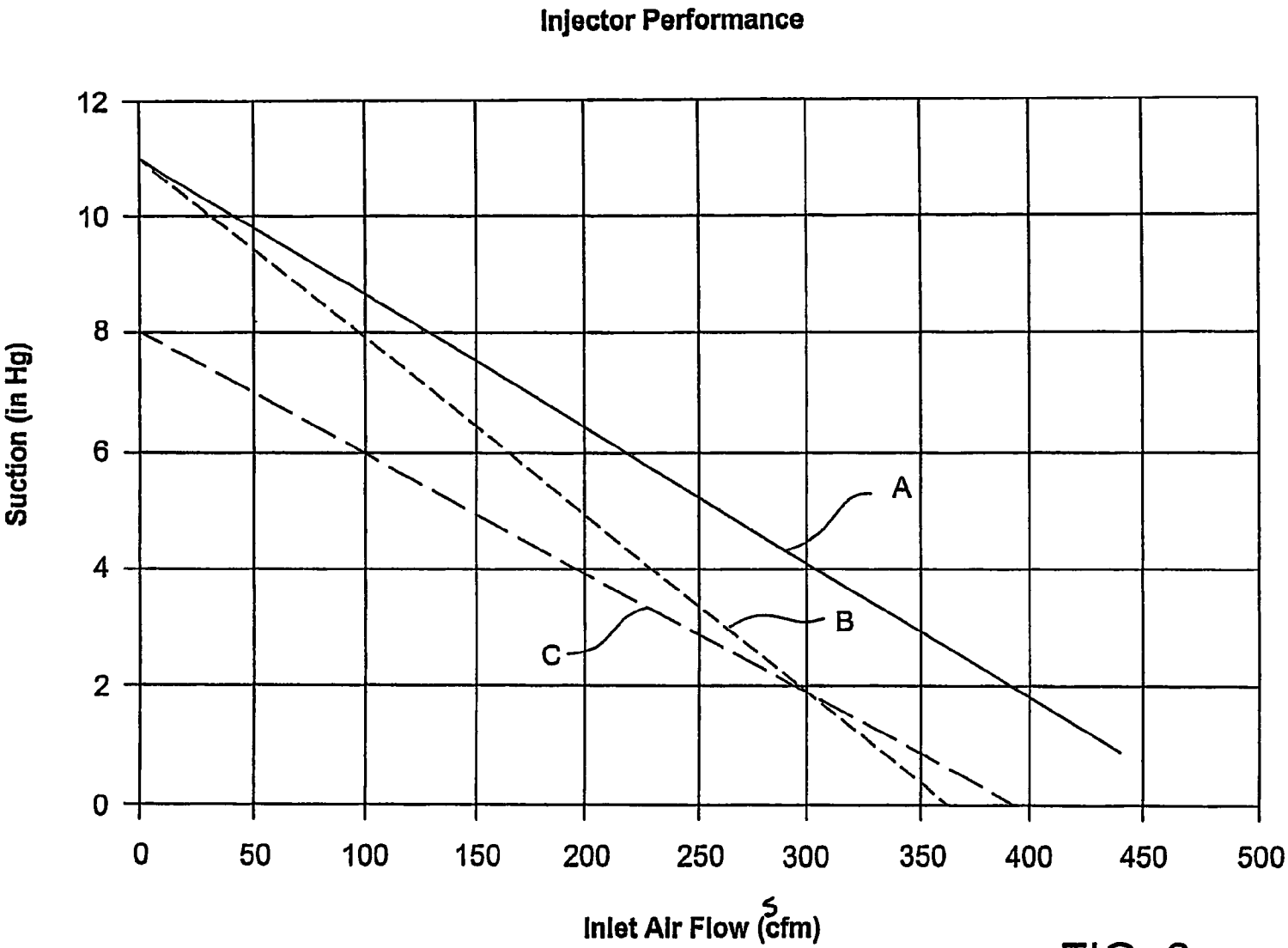
FIG. 6 is a graph showing the performance of the air powered vacuum apparatus of the invention compared to commercially available air powered vacuum apparatuses.

In FIG. 6, line A represents the injector assembly 3 of the invention having an air inlet flow of 150 scfm (standard cubic feet/minute) at 90 psi. Line B represents a first commercially available injector assembly with an air inlet flow of 167 scfm at 110 psi, and line C represents a second commercially available injector assembly with an air inlet flow of 145 scfm at 102 psi. At an intermediate point on the head flow curve, for example, 300 cfm in FIG. 6, it can be seen that the supersonic nozzle assembly 27, when used with injector 29 (represented by line A), increases the available suction in the system two fold compared to the commercially available air powered vacuum apparatuses. That is, the suction or vacuuming force (in Hg) for the invention (line A) is slightly greater than 4.0 Hg compared to 2.0 Hg for the comparison devices (line B and line C).

Figure 5:
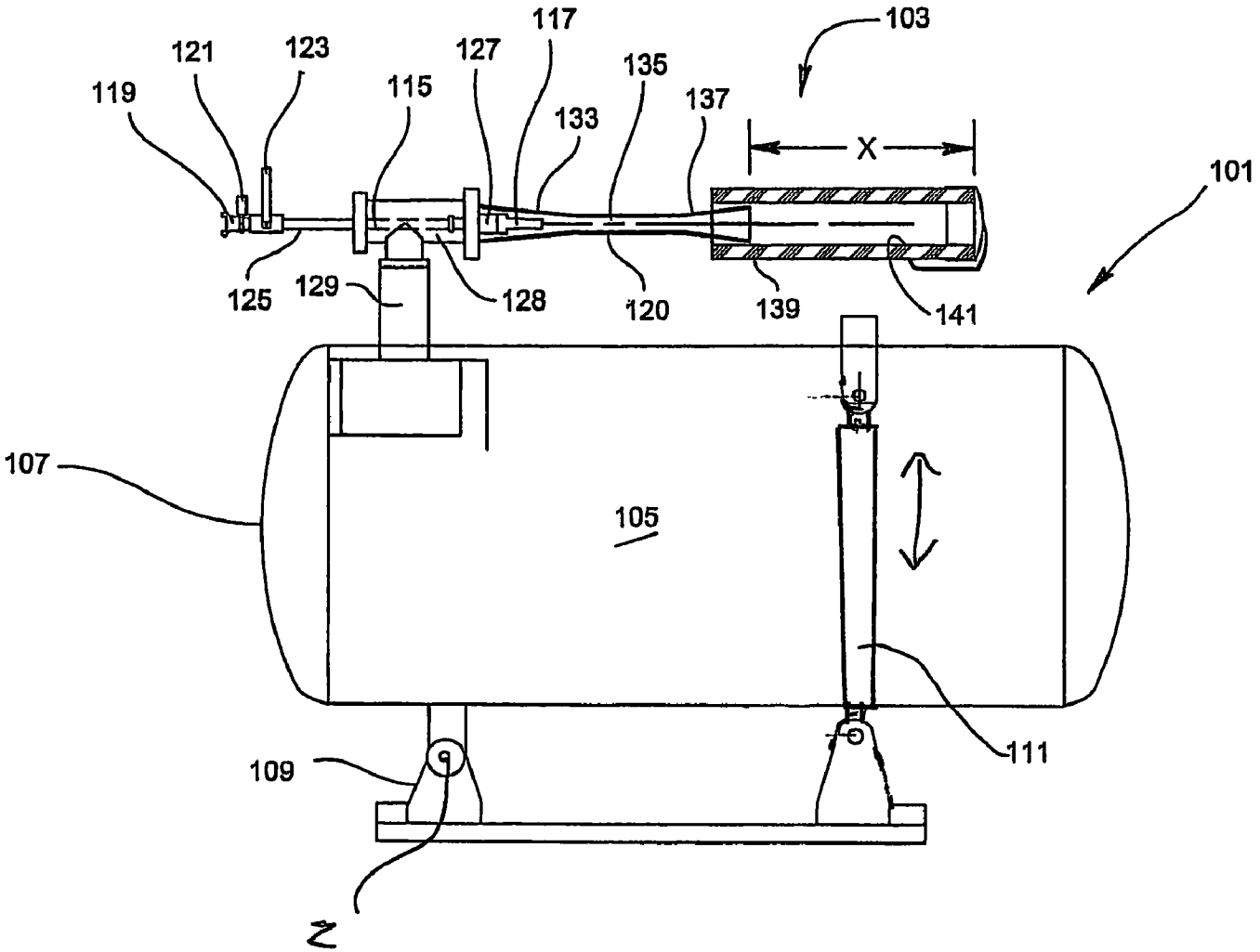
FIG. 5 is a schematic elevational view of an air powered vacuum apparatus of a second embodiment of the invention in a horizontal positioning made in accordance with the present invention.

FIG. 5 illustrates a second embodiment of the air powered vacuum apparatus 101 of the invention where apparatus 101 is in a horizontal position. This embodiment is well suited for mounting the air vacuum apparatus on a truck or trailer. As can be seen, in this embodiment an injector assembly 103 is located parallel to and above a container 105. A pivotal door 107 allows removal of spoil in container 105, which, in turn, is supported by pivotal arrangement 109 and hydraulic cylinder arrangement 111. Hydraulic cylinder arrangement 111 is used to pivotally raise and lower container 105 for spoil removal purposes about the Z axis. The air powered vacuum apparatus 101 has similar features and operates in the same manner as that described above for the first embodiment of the invention, except for those differences just mentioned. However, in this instance, the injector assembly 103 will direct air and noise outwardly away from the work area.

FIG. 5 shows the injector assembly 103 which includes a conduit 115 and a supersonic nozzle assembly 117. Conduit 115 includes a coupling 119, a pressure gauge 121, a ball valve 123, a threaded conduit 125 with a nipple, and a nozzle connector 127, and supersonic nozzle assembly 117 is connected to conduit 115 via nozzle connector 127. Conduit 115 and nozzle assembly 117 are supported on container 105 via a tee conduit 128 and a pipe 129. Nozzle assembly 117 projects into an injector 120 and is comprised of tee conduit 128, a converging section 133, a straight section 135 and a diverging section 137. A tube 139 has a cylindrical inner foam surface 141 and is attached preferably, through suitable means (not shown) to the end of the diverging section 137 of injector 120. Tube 138 extends a length "X" from the top of the diverging section 137 of injector 120.

The components of FIG. 5 are constructed and in general operate similarly to its corresponding components for the injector assembly 3 of the first embodiment. As discussed hereinabove, by positioning the tube 139 a length "X" adjacent to diverging section of the injector assembly, a simpler and more silent air vacuum arrangement is created compared to commercially available air vacuum arrangements. Also, as shown in FIG. 5, the container 105 may be laid on its side for ease of movement and the size of the container 105 may be any size and still operate effectively with the injector 120, supersonic nozzle assembly 117, injector assembly 103, and coupling 119 in a manner similar to that of the first embodiment of the invention.

In both embodiments of the invention, the containers 5 and 105 may be made of durable powder coated steel. It is important to note that the size and holding capacity of containers 5 and 105 are independent from the vacuum creating capability of the injectors 29 and 120. That is, containers 5 and 105 can be any size and the injectors 29 and 120 will still operate efficiently. Therefore, the invention can provide a system that has a large capability compared to the commercially available systems and at very conservative costs since the machinery usually associated with vacuum pumps, such as root blowers and centrifugal fans, are eliminated.

Table 2 indicates representative container sizes, i.e., volume (in gallons), and the volume (in cubic yards) of spoil that these containers can draw in at an excavation site when these tanks or containers are used in conjunction with the other components of the invention, such as the injector 29 and the nozzle assembly 27 of the first embodiment.

TABLE 2

Tank Sizes and Capacities

| Volume (Gal.) | Volume (Cu. Yds.) | Diameter (inch) | Length (inch) |
|---|---|---|---|
| 50 | .25 | 18 | 41 |
| 100 | .50 | 24 | 46 |
| 200 | 1.00 | 30 | 60 |
| 300 | 1.50 | 36 | 61 |
| 500 | 2.50 | 48 | 55 |

It has been found by the inventors particularly with reference to the first embodiment of FIG. 1, that the air powered vacuum device of the invention can readily vacuum from 1 to 2 cubic feet per minute of spoil and that it can hold has much as 0.25 cubic yard of spoil, i.e., 475 to 600 pounds, thereby representing the amount of spoil in an excavated hole which is 12 inches wide and over 6 feet deep.

While the present invention has been set forth in terms of specific embodiments thereof, it will be understood in view of the instant disclosure that numerous variations upon the invention are now enabled yet reside within the scope of the invention. For example, it is to be appreciated that the fluid drawn into and existing in the containers and the supersonic nozzles is disclosed as being air, but may be another fluid. Accordingly, the invention is to be broadly construed and limited only by the scope and spirit of the claims now appended hereto.

What is claimed is:

1. An air powered vacuum apparatus for use in an air vacuum excavation system, comprising:

a container for drawing in and collecting spoil;

a rigid suction tube and flexible hose assembly in communication with an interior of the container for drawing spoil and air into the container; and an injector assembly connected to and in communication with the container and with a supply of compressed fluid configured to convert the compressed fluid into supersonic fluid and then into subsonic fluid and to create a vacuum for drawing the spoil into the container, wherein the injector assembly comprises:

a conduit having a fluid inlet in communication with the container and adapted to be in fluid communication with the compressed fluid supply, a supersonic nozzle assembly connected to compressed air supply for using the compressed fluid and ejecting supersonic fluid, and an injector associated with the supersonic nozzle assembly and the conduit, comprising at least a converging section, a straight section and a diverging section, wherein the supersonic nozzle assembly is positioned inside the converging section of the injector, wherein the straight section of the injector acts as a mixing chamber for mixing the supersonic fluid from the nozzle assembly with the fluid traveling from the container, wherein the conduit has a straight length that extends beyond the diverging section of the injector for the reduction of the sound level of fluid being ejected from the diverging section of the injector of the injector assembly, and wherein the rigid suction tube and flexible hose assembly and the injector assembly are separately connected to the container.

2. The air powered vacuum apparatus of claim 1, wherein the container further comprises:

an impact plate assembly in close proximity to the suction tube and flexible hose assembly, the impact plate assembly configured so that the spoil being drawn through the suction tube and flexible hose assembly hits against the impact plate assembly and drops into the container, and outlet conduit means in fluid communication with the container and with at least the injector of the injector assembly, and including a filter conduit, whereby in operation, air brought into the container via the suction tube and flexible hose assembly passes through the filter conduit, flows into the converging section of the injector, mixes with the supersonic air ejected from the supersonic nozzle assembly in at least the straight section of the injector, and the mixed air passes into the diverging section of the injector and out of the straight length of the tube.

3. The air powered vacuum apparatus of claim 1, wherein the conduit is comprised of at least a tube, wherein the tube houses the injector and wherein the straight section of the injector is located between and in communication with the converging section and the diverging section of the injector.

4. The air powered vacuum apparatus of claim 1, wherein the conduit is comprised of at least a tube, wherein the tube is connected to the diverging section of the injector, and wherein the straight section of the injector is located between and in communication with the converging section and the diverging section of the injector.

5. The air powered vacuum apparatus of claim 1, wherein the conduit is comprised of at least a tube and wherein the tube comprises acoustic material.

6. The air powered vacuum apparatus of claim 5, wherein the tube of the injector assembly is comprised of a cylindrical inner surface layer made of acoustic material and an outer surface made of a material selected from the group consisting of steel, polyvinyl chloride and plastic.

7. The air powered vacuum apparatus of claim 6, wherein the tube further comprises a removable cap for protecting the injector assembly when the cap is positioned on the tube and allowing the air to exit when the cap is removed from the tube.

8. The air powered vacuum apparatus of claim 1, wherein the supersonic nozzle assembly in cooperation with the injector assembly is adapted to create a vacuum in the container for drawing spoil and air into the container.

9. The air powered vacuum apparatus of claim 1, wherein the injector comprises:

a reducer on its fluid inlet end for feeding and channeling the air around the supersonic nozzle and for reducing fluid entrance losses, and a diffuser on its fluid exit end for converting the velocity of the air into pressure.

10. The air powered vacuum apparatus of claim 1, wherein the container further comprises:

a door located at the bottom of the container for removal of the spoil, a drain plug for water removal from the container, a pair of wheels, and a foot having a rubber surface and attached to the outer bottom of the container opposite the pair of wheels for supporting and stabilizing the container.

11. The air powered vacuum apparatus of claim 1, wherein the container and the injector assembly are positioned in a vertical positioning.

12. The air powered vacuum apparatus of claim 1, wherein the container and the injector assembly are positioned in a horizontal positioning, and the container further comprises a pivot and a hydraulic cylinder adapted for pivotally raising and lowering the container for material removal purposes, about the pivot.

13. The air powered vacuum apparatus of claim 1, wherein the container is constructed of material selected from the group consisting of steel and aluminum.

14. The air powered vacuum apparatus of claim 1, further comprising:

an air jet digging tool for directing air at supersonic speeds at the spoil to be excavated and drawn into the container, and an air compressor having connections to the air jet digging tool and providing the supply of compressed air to the injector assembly.

15. The air powered vacuum apparatus of claim 1, wherein a length of the straight section of the injector is approximately 7 to 8 times greater than a diameter of the straight section of the injector.

16. The air powered vacuum apparatus of claim 15, wherein the supersonic nozzle assembly is positioned inside the converging section of the injector such that a ratio of an annular area between the converging section and a tip of the supersonic nozzle assembly to an area of the straight section of the injector is approximately two.

17. The air powered vacuum apparatus of claim 1, wherein the supersonic nozzle assembly is positioned inside the converging section of the injector such that a ratio of an annular area between the converging section and a tip of the supersonic nozzle assembly to an area of the straight section of the injector is approximately two.

18. An injector assembly for creating an air flow under vacuum and for reducing the sound level of the exhausting air, comprising:

a conduit adapted to be coupled to a compressed air supply, a supersonic nozzle connected to the conduit for using the compressed air and converting it into supersonic air and for ejecting the supersonic air, and an injector adapted to be associated with an air source and being in fluid communication with the supersonic nozzle, and comprising a converging section, a straight section and a diverging section, wherein the conduit is comprised of at least a tube associated with the diverging section of the injector, wherein the supersonic nozzle is positioned inside the converging section of the injector assembly, wherein the tube has a length that extends beyond the diverging section of the injector, and wherein a length of the straight section of the injector is approximately 7 to 8 times greater than a diameter of the straight section of the injector.

19. The injector assembly of claim 18, further comprising a removable cap for allowing the air to exit the tube when the cap is removed and for protecting the injector when the cap is in position on the tube.

20. The injector assembly of claim 18, wherein the supersonic nozzle in cooperation with the injector creates a vacuum effect in the air source for drawing at least air into the air source and through the injector which mixes with the supersonic air ejected from the supersonic nozzle assembly and which mixed air is exhausted out of the tube of the injector assembly.

21. The injector assembly of claim 18, wherein the tube comprises acoustic material.

22. The injector assembly of claim 18, wherein the straight section of the injector is located between and in communication with the converging section and the diverging section of the injector.

23. The injector assembly of claim 18, wherein the supersonic nozzle assembly is positioned inside the converging section of the injector such that a ratio of an annular area between the converging section and a tip of the supersonic nozzle assembly to an area of the straight section of the injector is approximately two.

24. An air powered vacuum apparatus, comprising:

a container for collecting spoil and air;

a rigid suction tube and flexible hose assembly in communication with the container for drawing spoil and air into the container; and an injector assembly in fluid communication with the container for creating an air flow under vacuum and for reducing the sound level of the exhausting air, comprising:

an injector having a converging section, a straight section and a diverging section, a supersonic nozzle assembly optionally positioned in the converging section of the injector for converting the compressed air into supersonic air and for ejecting the supersonic air into the converging section, and a tube having a length that extends beyond the diverging section for reducing the sound level of air ejected from the diverging section, wherein the straight section of the injector acts as a mixing section for mixing the supersonic air from the supersonic nozzle with the air drawn from the container, so that in operation, the mixture of air travels into the diverging section of the injector, and the supersonic air traveling through the injector creates a vacuum for drawing the spoil and air into the container, and wherein the rigid suction tube and flexible hose assembly and the injector assembly are in separate communication with the container.

25. The air powered vacuum apparatus of claim 24, wherein the supersonic nozzle assembly is positioned inside the converging section of the injector such that a ratio of an annular area between the converging section and a tip of the supersonic nozzle assembly to an area of the straight section of the injector is approximately two.

26. The air powered vacuum apparatus of claim 24, wherein a length of the straight section of the injector is approximately 7 to 8 times greater than a diameter of the straight section of the injector.

27. The air powered vacuum apparatus of claim 26, wherein the supersonic nozzle assembly is positioned inside the converging section of the injector such that a ratio of an annular area between the converging section and a tip of the supersonic nozzle assembly to an area of the straight section of the injector is approximately two.

* * * * *